US006109255A

United States Patent [19]

Dieckmann et al.

[11] Patent Number: 6,109,255

[45] Date of Patent: Aug. 29, 2000

[54] APPARATUS AND METHOD FOR MODULATING THE FIRING RATE OF FURNACE BURNERS

[75] Inventors: John T. Dieckmann, Belmont; David H. McFadden, Lexington; Gautum Gauba, Marlborough, all of Mass.; Werner Specht, Sharpeville, Pa.

[73] Assignee: Gas Research Institute, Chicago, Ill.

[21] Appl. No.: 09/243,588

[22] Filed: Feb. 3, 1999

[51] Int. Cl.[7] ..... F23N 3/00

[52] U.S. Cl. ..... 126/116 R; 126/67

[58] Field of Search ..... 126/116 R, 116 A, 126/85 R, 67, 312; 236/1 G; 431/20

[56] References Cited

U.S. PATENT DOCUMENTS

| | | | |
|---|---|---|---|
| 2,221,750 | 11/1940 | Ashby et al. | 236/1 G |
| 4,373,897 | 2/1983 | Torborg | 431/20 |
| 5,158,446 | 10/1992 | Hall | 431/20 |
| 5,687,708 | 11/1997 | Farnsworth et al. . | |

FOREIGN PATENT DOCUMENTS

| | | | |
|---|---|---|---|
| 58-14 | 1/1983 | Japan | 236/1 G |

OTHER PUBLICATIONS

*Reznor Duct Furnaces, Specifications and Techical Guide*, Form No. RGM–C–DF–A.1, Thomas & Betts Corporation, Mar. 1996.

*Reznor Indirect Fired Heating & Make–up Air Products Specifications and Techical Guide*, Form No. RGM–C–PH–A, Thomas & Betts Corporation, Aug. 1995.

*Primary Examiner*—Ira S. Lazarus
*Assistant Examiner*—Sara Clarke
*Attorney, Agent, or Firm*—Pauley Petersen Kinne & Fejer

[57] ABSTRACT

A modulating furnace includes a first air flow path which directs supply air to one or more combustion burners and through a heat exchanger, and a second air flow path which directs supply air around the one or more burners and heat exchanger. When the firing rate of the burners is lowered, the amount of air to the burners is reduced by diverting a greater fraction of the supply air to the second air flow path. When the firing rate of the burners is raised, less supply air is diverted resulting in greater flow to the burners. The duct furnace achieves ideal combustion at high and low firing rates by maintaining an ideal balance between firing rates and air supplied to the burners.

19 Claims, 3 Drawing Sheets

APPARATUS AND METHOD FOR MODULATING THE FIRING RATE OF FURNACE BURNERS

FIELD OF THE INVENTION

This invention is directed to an apparatus and method for modulating the firing rate of partial pre-mix burners, such as ribbon-type, bar-type or in-shot burners in duct furnaces, indirect fired make-up air heaters, similar warm air heating devices, and other heating appliances.

BACKGROUND OF THE INVENTION

The duct furnace with ribbon burners and an oval tubular heat exchanger is a low cost warm air heating device used in commercial and industrial heating. Applications include unit heaters, ducted warm air heating systems and ventilation make-up air heaters. In certain applications, particularly ventilation make-up air heaters, it is desirable to be able to modulate the heating output of the duct furnace by varying the firing rate of the burners. One purpose of modulating the output of a ventilation make-up air heater is to provide constant make-up air delivery temperature over the normal range of outdoor ambient temperatures. To best meet this objective, it is desirable to be able to modulate the burners over as wide a range as possible.

In a conventional indirect fired make-up air heater, an induced draft blower is used to provide essentially constant combustion air flow in a variety of configurations ranging from sealed combustion to roof top mounted. In the latter case, the induced draft system minimizes the effect of wind speed and direction on combustion air flows. In order to provide a more constant heated make-up air delivery temperature, stepped and continuous modulation is available in this type of unit, but generally is limited to turn-down ratios of 2:1, i.e., the minimum firing rate is 50% of the maximum firing rate. At firing rates below this level, both the combustion quality and the thermal efficiency deteriorate below levels that are acceptable with respect to industry safety certification standards. In particular, carbon monoxide (CO) levels increase.

As the firing rate of a partial pre-mix burner, such as a ribbon burner, is reduced without reducing the combustion air flow rate, a point is reached where the cool secondary air flow quenches the combustion of the outer portions of the flame, causing the aforementioned increase in CO levels. If the combustion air flow rate is reduced in tandem with the firing rate, acceptably clean combustion can be maintained to a lower firing level, before other quenching effects, such as the cooling effect of burner walls and heat exchanger walls cause CO levels to rise. In a heating device certified for sale in the U.S., reduction of the combustion air flow rate can be constrained by the requirement to sense an obstruction to combustion air flow, either a blocked flue vent or a blocked air intake.

SUMMARY OF THE INVENTION

The invention includes an apparatus and method for modulating the firing rate of furnace burners. Specifically, the invention provides an apparatus and method which reduces combustion air flow to the furnace at low firing conditions, while permitting a conventional pressure differential sensing system to perform the function of detecting a flow blockage. As explained in detail below, this is accomplished by diverting a portion of the combustion air supply past the combustion system and directly into the furnace exhaust system where the differential pressure sensor is located.

BRIEF DESCRIPTION OF THE DRAWINGS

FIG. 1(*b*) is a front schematic view of the duct furnace of FIG. 1;

FIG. 2(*b*) is a front schematic view of the duct furnace of FIG. 2(*a*);

FIG. 3(*b*) is a front schematic view of the duct furnace of FIG. 3(*a*).

DETAILED DESCRIPTION OF THE PRESENTLY PREFERRED EMBODIMENTS

Figure 1A:
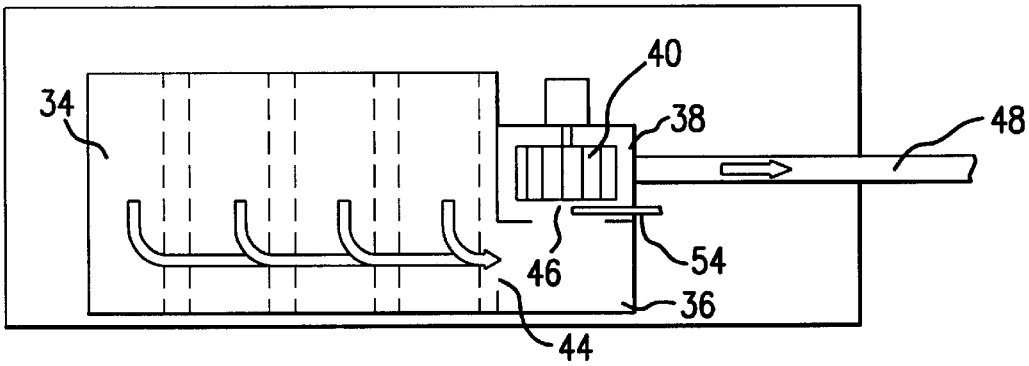
FIG. 1(a) PRIOR ART
FIG. 1(*a*) is a schematic view of a conventional duct furnace from above.
Figure 1B:
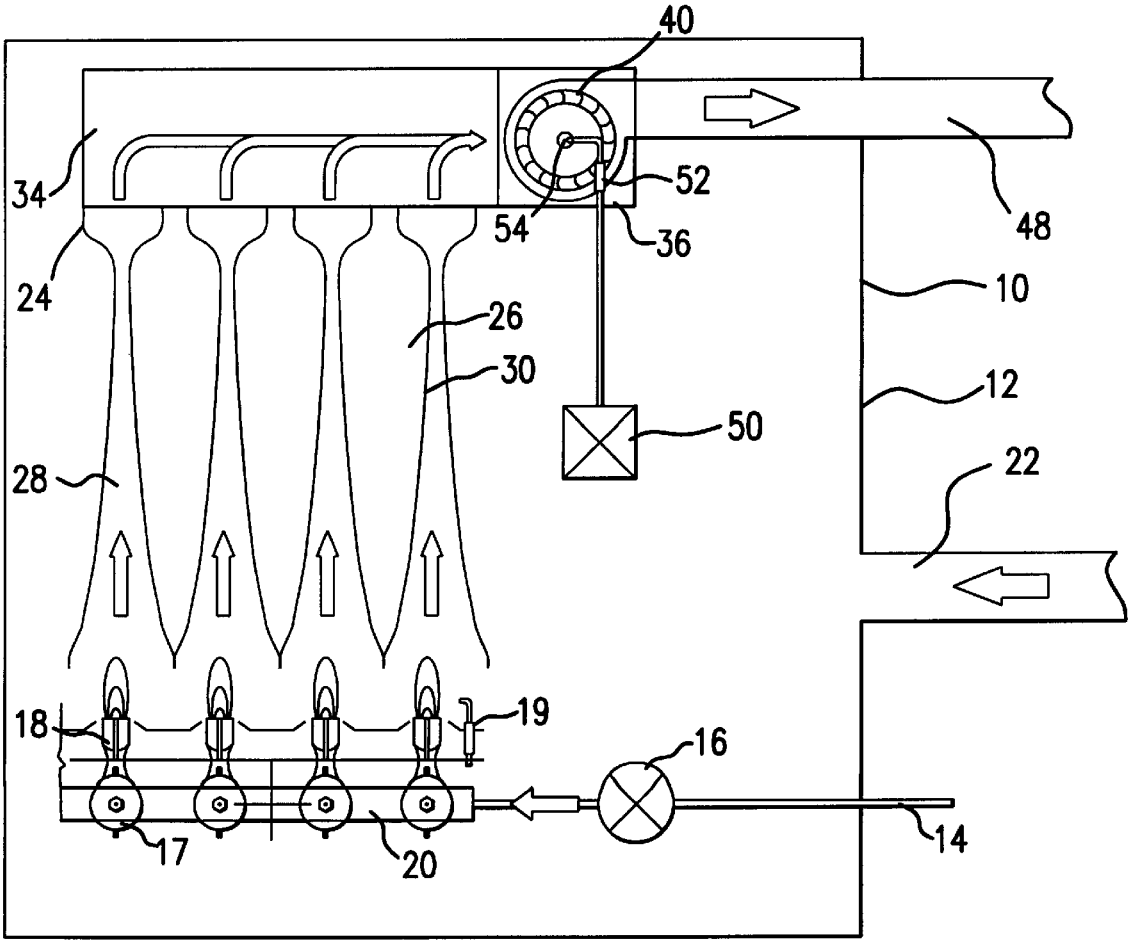
FIG. 1(b) PRIOR ART
Figure 2A:
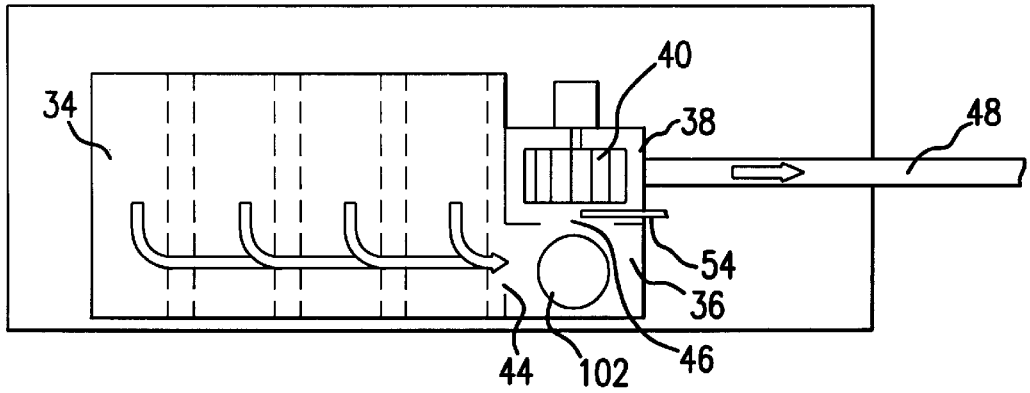
FIG. 2(*a*) is a schematic view of a first embodiment of the duct furnace of the invention from above.
Figure 2B:
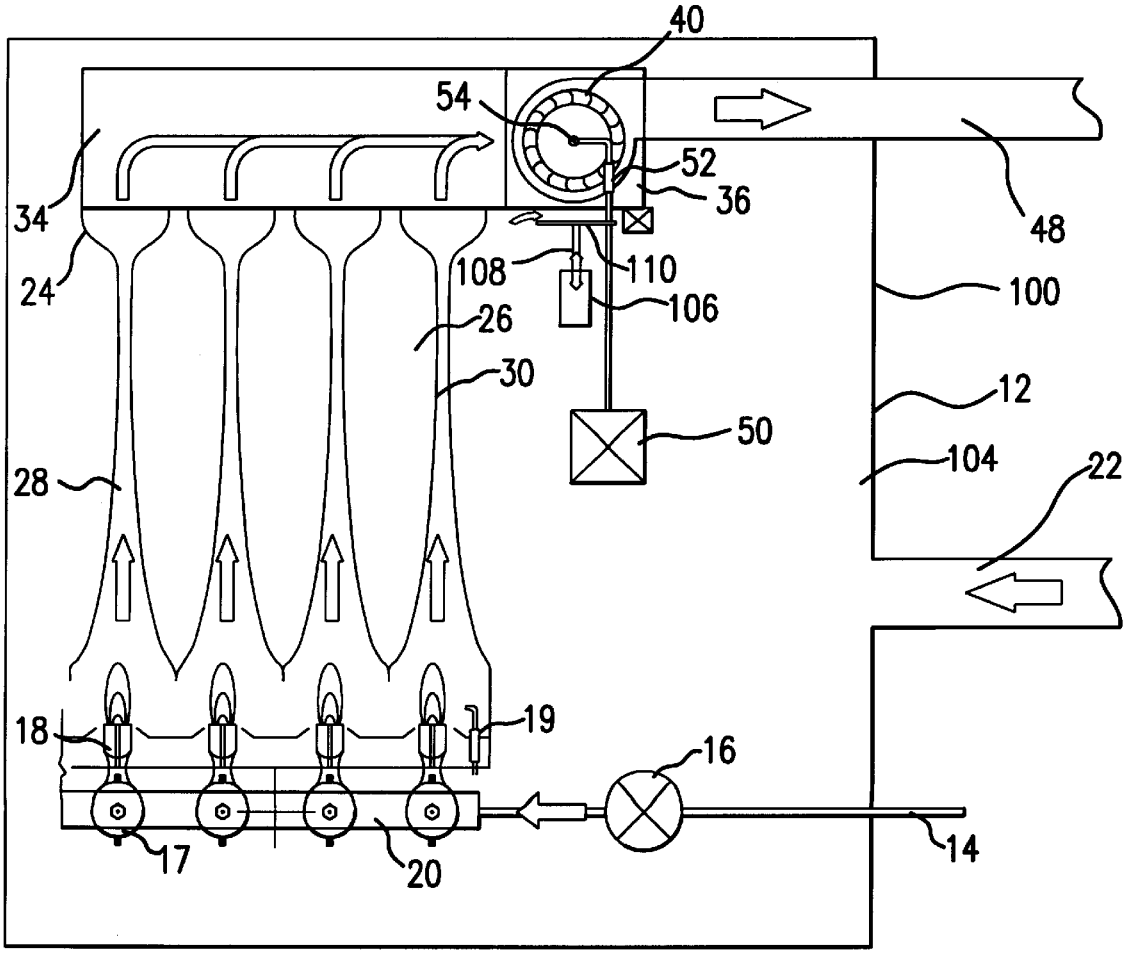

FIGS. 1(*a*) and 1(*b*) illustrate a conventional heating device, a modulating duct furnace of the prior art, which does not incorporate the improvements of the invention. FIGS. 2(*a*), 2(*b*), 3(*a*) and 3(*b*) illustrate improved heating devices of the invention. The furnaces have many similarities, indicating that the technology of the invention can be simply installed in conventional duct furnaces without requiring complete replacement or exchange of parts. The essential characteristics of the duct furnace are substantially similar to many other warm air heating devices.

Referring to FIGS. 1(*a*) and 1(*b*), the duct furnace 10 includes a housing 12 which is generally closed except for selected entrance and exit ports. Fuel gas, such as natural gas or another hydrocarbon gas, enters the furnace via gas inlet line 14 and modulating valve 16, and feeds one or more ribbon-type burners 18 mounted to plenum 20. Combustion air enters the furnace housing though air supply port 22, which can be quite long, extending up to 50 feet or more to an external source.

The air and gas feed rates are maintained within a range, so that the combustion occurring at burners 18 is ideal. If the rate of air flow relative to fuel gas is either too low or too high, for instance, there is a risk of incomplete combustion, resulting in unacceptable carbon monoxide levels. Air flow which is too low relative to the fuel gas may be insufficient to cause complete combustion. If the fuel gas flow is too low relative to the air, part of the flame may be prematurely quenched by the air before combustion has been completed. A pilot burner 19 can be used to assist in lighting the main burners.

As shown in FIG. 1(*b*), a heat exchanger 24 is mounted above the burners 18 and includes one or more tubes 28 running substantially vertically and one or more air-side channels 26 running perpendicular to the drawing between the tubes. The heat exchanger 24 is configured and mounted so that a tube 28 is located directly above each burner 18, and each channel 26 passes the air which is being heated. The heated combustion products flowing upward through tubes 28 heat air or another fluid flowing through the channels 26. The channel side of the heat exchanger is conventional and not important to this invention, and is not described in detail.

The various arrows in FIGS. 1(*a*) and 1(*b*) illustrate the direction of flow through the corresponding ducts and channels. After flowing upward through the tubes 28, the hot flue gases enter a flue box 34. A collector plenum 36 receives the flue gases from flue box 34. A blower section 38 receives the flue gases from the collector plenum, and facilitates both suction and ventilation of the spent flue gases. The blower section 38 houses an induced draft combustion air blower 40, which draws the flue gases from the collector plenum 36 via flow control orifice 46.

The air suction blower 40 is the driving force behind the circulation of combustion air inside the furnace. The blower 40, which can be a squirrel cage fan, creates an overall steady state suction which pulls combustion air into the furnace housing via inlet conduit 22, then to the burners 18 and up through tubes 28, into flue box 34, then through a first orifice 44 leading from the flue box to collector plenum 36, then through second orifice 46 and into the blower section 38 and squirrel cage blower impeller 40, which expels the hot flue gas out of the furnace and through ventilator duct 48.

The furnace 10 of the prior art is configured so that no other flow path is possible for the combustion air. Except for the inlet orifices 44 and 46 leading from the flue box and the collector plenum, and the exhaust vent 48, the blower section 38 is sealed from the remainder of the furnace. Thus, all of the combustion air entering duct 22 due to suction pressure must pass the burners 18 to facilitate combustion, and enter the heat exchanger tubes 28 leading to the flue box 34.

One risk associated with conventional furnace 10 is that either the inlet air duct 22 or the ventilation duct 48 (both of which can be 50 feet or more in length) will become obstructed by birds, animal, debris, or other objects. An obstruction in either duct can reduce the flow of air through the furnace, thereby increasing the ratio of fuel gas to air reaching the burners 18. The resulting imbalance leads to incomplete combustion and the production of carbon monoxide gas. To alleviate this problem, a pressure monitor 50 is provided in communication with a pressure sensor 52, which in turn is mounted with a probe between the blower impeller 40 and the adjacent orifice 46. The location of the probe 54 is the region of highest suction pressure in the furnace. The pressure monitor 50 typically measures a vacuum of about 1.0–1.5 inches of water during normal operation of the furnace.

When the inlet duct 22 or vent 48 becomes obstructed, the pressure drop approaching blower impeller 40 is reduced. When the pressure reading falls below a target level, the pressure monitor 50 sends a signal to the main gas valve 15, causing valve 15 to shut off the gas supply in line 14 leading to the burners. Combustion is terminated, thereby preventing a build-up of carbon monoxide. When the blockage is cleared, the valve 15 can be re-opened, and combustion can resume.

In a modulating furnace such as the furnace 10, it is often desirable to provide just enough heat so that the air flowing through channels 26 reaches an aggregate (i.e. average) temperature set to a desired target, for example, a typical indoor room temperature of 65–75° F. To accomplish this, the combustion occurring at the individual burners 18 is raised and lowered, in a predetermined programmed sequence. However, in order for the pressure monitor 50 to perform its intended function of detecting blockages, the total air flow through the orifice 46 (and, thus, to the burners 18 and through the entire furnace) must be maintained at a relatively constant level. The only remaining way to modulate the burners is to raise and lower the fuel gas supply to the individual burners 18 using modulating valve 16 associated with supply plenum 20 and gas nozzles 17. Because of the incomplete combustion resulting when the air supply and gas supply become imbalanced, the amount of fuel gas supplied to the individual burners 18 (at constant air supply) can only be varied within a relatively narrow range. Typically, the minimum amount of fuel gas which can be provided to an individual burner, at constant air supply, is about 50% or more of the maximum amount of fuel gas which can be supplied. As a result, the typical modulating duct furnace 10 can only provide heating to an environment within a limited temperature range.

The invention provides a technology adaptable to conventional modulating duct furnaces, which permits reduction of the air supply to the burners without affecting the operation of the pressure monitor near the air blower. By providing a lower air supply to the burners, the amount of combustion gas fed to the individual burners can be reduced to a much lower level (i.e. to below 50% of its maximum level) without creating an imbalance between gas and air that causes incomplete combustion. The flexibility of the modulating duct furnace 10 is thus increased so that heated air from the channels 26 can be supplied over a wider temperature range.

Referring to FIGS. 2(*a*) and 2(*b*), a duct furnace 100 of the invention is provided having all of the features of the prior art furnace 10 in FIGS. 1(*a*) and 1(*b*), with like elements being numbered in like fashion. Additionally, the furnace 100 has a bypass opening 102 between the collector plenum 36 and the adjacent portion 104 of housing 12, which permits some of the combustion air supply entering the inlet 22 to completely bypass the burners 18 and tubes 28 in the heat exchanger.

In effect, the furnace 100 has two loops instead of one through which combustion air can flow. In the first loop, some of the combustion air enters housing 12 through inlet 22 and flows to burners 18, heat exchanger tubes 28, flue box 34, collector plenum 36, blower section 38, impeller 40 and vent 48. In the second loop, some of the combustion air enters housing 12 through vent 22 and flows directly to collector plenum 36, blower section 38, impeller 40 and vent 48, completely bypassing the burners 18 and heat exchanger 24.

The amount of combustion air flowing through the second loop, versus the first loop, can be varied by adjusting the position of bypass valve 106, either in continuous or stepwise fashion. Valve 106 includes a valve piston 108 and valve gate 110 which, when closed, engages the blower chamber 36 to completely block the bypass opening 102. When valve 106 is closed, all of the combustion air flows through the first loop. When valve 106 is open to varying degrees, various fractions of the combustion air can be made to flow through the second (bypass) loop. For instance, up to one-half (or more) of the total combustion air flow can be made to bypass the burners and heat exchanger via the second loop.

Without significantly varying the total flow of combustion air through the first and second loops, the combustion air supply to the burners 18 (first loop) can be reduced in tandem with the fuel gas supply through line 14, valve 16, and with the firing rate of burners 18. This permits the firing rates to be reduced to very low levels, which are less than one-half of the maximum firing rates, while avoiding the incomplete combustion caused by the cooling effects of excessive air flow to the burners. Acceptably clean combustion is maintained at much lower firing levels than with prior art modulating duct furnaces, and the furnace is permitted to operate over a wider temperature range.

The combined (i.e. sum total of) air flows from the first (burner) loop and second (bypass) loop through the flow control/sensing orifice 46, and affect pressure sensor 52. The combined air flow through the first and second loops is nearly constant; only the respective fractions of the total air flow through each loop are varied. Therefore, the pressure sensing device 50 will respond to an external blockage of air flow in the same fashion, regardless of the relative fractions of air flow passing through each loop.

Figure 3A:
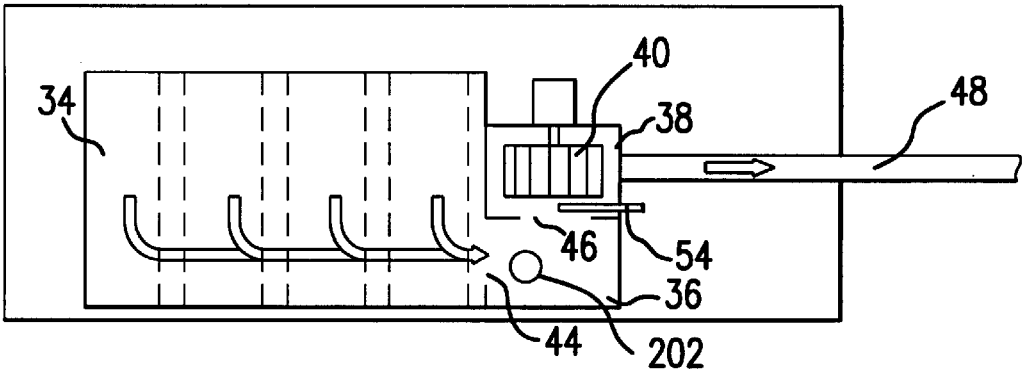
FIG. 3(*a*) is a schematic view of a second embodiment of the duct furnace of the invention from above.
Figure 3B:
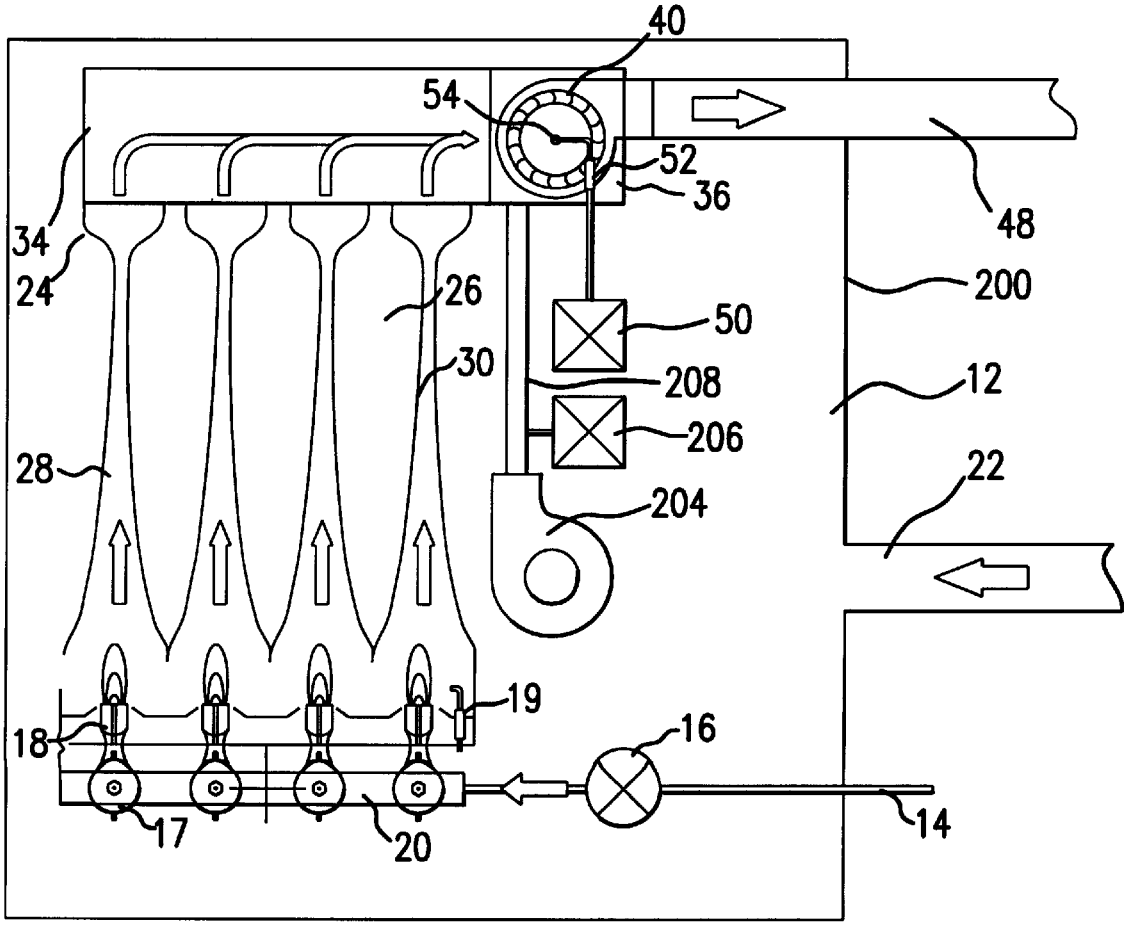

FIGS. 3(*a*) and 3(*b*) illustrate a second embodiment of the invention. In the duct furnace 200 of the second embodiment, bypass combustion air is drawn into the second loop by a bypass blower 204, which forces air through line 208 and opening 202, into the collector plenum 36. The amount of bypass air flowing through the second loop can be monitored by pressure gauge 206 in the line 208. The advantage of the duct furnace 200 is that the bypass air, instead of merely being drawn into the collector plenum 36 using suction, is instead forced into the blower section 38 in a more controlled fashion. Otherwise, the principals of operation of the modulating duct furnace 200 of the invention are very similar to those described above for the modulating duct furnace 100 of the invention.

While the embodiments described herein are presently considered preferred, various modifications and improvements can be made without departing from the spirit and scope of the invention. For instance, heating devices with pressure based blocked combustion air flow sensing which have variations in the flue gas path from those described above are within the scope of this invention. The scope of the invention is indicated by the appended claims, and all changes that fall within the meaning and range of equivalents are intended to be embraced therein.

We claim:

1. A heating device, comprising:

a housing;

an air supply port leading into the housing;

one or more burners in the housing;

a gas supply line for supplying hydrocarbon fuel gas to the one or more burners;

a heat exchanger above the one or more burners including one or more heat exchanger tubes, and one or more channels between the tubes;

a flue box above the heat exchanger;

a collector plenum and a blower section in communication with the flue box;

an induced draft air blower in the blower section;

a vent leading from the blower section out of the housing;

a bypass opening in the collector plenum leading from a lower portion of the housing into the collector plenum; and a bypass air blower for regulating air flow through the bypass opening.

2. The heating device of claim 1, wherein some of the air entering the housing passes through a first loop via the one or more burners, the one or more heat exchanger tubes, the flue box, the collector plenum, the blower section and the vent; and some of the air entering the housing passes through a second loop which bypasses the one or more burners via the bypass opening, the collector plenum, the blower section and the vent.

3. The heating device of claim 1, further comprising an adjustable valve for the bypass opening.

4. A heating device, comprising:

an air supply opening;

one or more burners;

a heat exchanger in communication with the one or more burners;

a flue box in communication with the heat exchanger;

a collector plenum in communication with the flue box;

an induced draft blower in communication with the collector plenum;

a vent leading away from the collector plenum; and a bypass opening in the collector plenum;

the one or more burners, heat exchanger, flue box, collector plenum and induced draft blower arranged so that a first air flow path passes the one or more burners, the heat exchanger, the flue box, and the collector plenum;

a second air flow path bypasses the one or more burners, heat exchanger, and flue box, and passes the bypass opening and the collector plenum; and a bypass air blower associated with the bypass opening, the bypass air blower regulating quantities of air flow in the first air flow path and the second air flow path.

5. The heating device of claim 4, further comprising an adjustable valve associated with the bypass opening.

6. The heating device of claim 4, wherein the quantities of air flow in the first and second flow paths add up to a substantially constant air flow.

7. The heating device of claim 4, further comprising a pressure sensor adjacent the induced draft blower.

8. The heating device of claim 7, wherein the pressure sensor is affected by a sum total of air flows in the first air flow path and the second air flow path.

9. A heating device, comprising:

an air supply port;

one or more burners having maximum and minimum firing rates;

a heat exchanger including a tube above each burner;

a first flow path which carries a first quantity of gas from the air supply port to the one or more burners and through the one or more heat exchanger tubes;

a second flow path which carries a second quantity of air from the air supply bypassing the one or more burners and one or more heat exchanger tubes; and a bypass air blower for lowering and raising a quantity of air in the first flow path by adjusting the quantity of air diverted to the second air flow path.

10. The heating device of claim 9, wherein the minimum firing rate of each burner is less than 50% of the maximum firing rate.

11. The heating device of claim 9, further comprising an adjustable bypass valve.

12. The heating device of claim 9, wherein the sum total of the first and second quantities of air varies significantly only when the heating device is obstructed.

13. The heating device of claim 9, further comprising an induced draft blower which pulls air from the supply duct through the first and/or second flow paths.

14. The heating device of claim 13, wherein the induced draft blower comprises a squirrel cage fan.

15. The heating device of claim 9, further comprising a pressure sensor located in both of the first and second flow paths, for detecting a blockage.

16. A heating device, comprising:

an air supply port;

one or more burners having maximum and minimum firing rates;

a heat exchanger including a tube above each burner;

a first flow path which carries a first quantity of gas from the air supply port to the one or more burners and through the one or more heat exchanger tubes;

a second flow path which carries a second quantity of air from the air supply port bypassing the one or more burners and one or more heat exchanger tubes; and a pressure sensor located in each of the first and second flow paths, for detecting a blockage.

17. A heating device comprising:

an air supply opening or port;

one or more burners;

a heat exchanger in communication with the burners;

a flue gas collection device in communication with the heat exchanger;

a first air flow path which carries a first quantity of air from the supply opening or port to the one or more burners, through the heat exchanger, and into the flue gas collection device;

a second flow path which carries a second quantity of air from the supply opening or port to the flue gas collection device, bypassing the one or more burners and the heat exchanger;

a blower urging air through the first and second flow paths;

a device for raising or lowering an air flow rate in the first flow path in tandem with a firing rate of the one or more burners by adjusting an air flow rate diverted to the second flow path;

wherein a sum total of the air flow rates through the first and second flow paths remains essentially constant absent a blockage, regardless of the air flow rates in the first and second flow paths; and a pressure sensor in at least one of the first and second flow paths, for detecting a blockage.

18. The heating device of claim 17, wherein the device for adjusting the flow rate of air diverted to the second air flow path comprises an adjustable valve.

19. The heating device of claim 17, wherein the device for adjusting the flow rate of air diverted to the second air flow path comprises a bypass blower.

* * * * *